United States Patent [19]

Genini

[11] 4,271,873

[45] Jun. 9, 1981

[54] PAIR OF GRIPPERS FOR WEAVING LOOMS WITHOUT SHUTTLE

[75] Inventor: Graziano Genini, Stabio, Switzerland

[73] Assignee: Albatex A.G., Vaduz, Liechtenstein

[21] Appl. No.: 119,003

[22] Filed: Feb. 5, 1980

Related U.S. Application Data

[62] Division of Ser. No. 913,071, Jun. 6, 1978, Pat. No. 4,235,261.

[30] Foreign Application Priority Data

Jun. 9, 1977 [CH] Switzerland ..... 7102/77

[51] Int. Cl.[3] ..... D03D 47/18

[52] U.S. Cl. ..... 139/446; 139/448

[58] Field of Search ..... 139/429, 444, 445, 446, 139/447, 448

[56] References Cited

U.S. PATENT DOCUMENTS

| | | | |
|---|---|---|---|
| 2,072,161 | 3/1937 | Dewas | 139/448 |
| 2,116,620 | 5/1938 | Dewas | 139/448 |
| 3,159,186 | 12/1964 | Juillard | 139/448 |
| 3,580,291 | 5/1971 | Piccoli | 139/448 |
| 3,717,182 | 2/1973 | Sparling | 139/446 |
| 4,040,454 | 8/1977 | Genini | 139/448 |
| 4,129,155 | 12/1978 | Merisio | 139/448 |

*Primary Examiner*—Henry Jaudon

*Attorney, Agent, or Firm*—Young & Thompson

[57] ABSTRACT

A pair of grippers for shutterless looms, of the type wherein a first gripper (carrying) grasps the weft thread at one side of the loom and carries it to the center of the warp shed, while the second gripper (drawing) receives the weft thread at the center of the warp shed from the carrying gripper, and transports it to the opposite side of the loom, where it releases the same. The weft thread grasping and holding members are mounted on head parts of the grippers disposed on opposite sides of a sliding plane. Along said sliding plane said head parts move side by side, cooperating between them for grasping and releasing the weft thread.

1 Claim, 12 Drawing Figures

P
α
2
20
5
6
4
f
3
15
14
1
V

P
8
2
1
7

23
α
9
20
2
6
4
5
13
12
3
1
P
15
14
f

PAIR OF GRIPPERS FOR WEAVING LOOMS WITHOUT SHUTTLE

This is a division of application Ser. No. 913,071, filed June 6, 1978, now U.S. Pat. No. 4,235,261.

BACKGROUND OF THE INVENTION

The present invention relates to important improvements in the weft transport grippers for shuttleless looms, of the type wherein a first gripper (carrying) grasps the weft thread at one side of the loom and carries it to the centre of the warp shed, while the second gripper (drawing) receives the weft thread at the centre of the warp shed from the carrying gripper, and transports it to the opposite side of the loom, where it releases the same.

The pair of grippers according to the invention comprises grippers of reduced weight and dimensions which cooperate with each other without penetrating one into the other and which may move along a common plane, which may be differently oriented in respect of the plane of the loom reed.

SUMMARY OF THE INVENTION

The improved pair of weft transport grippers according to the invention is essentially characterized in that, in both grippers, the weft thread grasping and holding members are mounted on head parts of the grippers disposed on opposite sides of a sliding plane, along which said head parts move side by side, cooperating between them for grasping and releasing the weft thread. Said sliding plane may be parallel, perpendicular or differently inclined in respect of the plane of the loom reed.

The carrying gripper of the pair of grippers according to the invention is characterized by a rear part, whose side close to the sliding plane projects beyond said plane in respect of the head part of the gripper, so as to form a guide for the weft thread parallel to the plane itself, said head part comprising a pair of pegs for positioning the end of the weft thread, said pegs being arranged close to the free end of the thread grasping and holding means, on one side and on the other thereof, and in a position such as to cause the weft thread to be positioned between said guide and the first of said pegs only slightly inclined (about 25° at the most) in respect of the sliding plane.

Moreover, said carrying gripper mainly comprises a basic gripper body, the rear part of which is fixed to the gripper advancement strap and forms said guide for the weft thread, and the head part of which is equipped with said weft thread grasping and holding means, and a cover adapted to be applied on said basic body and comprising an opening for housing said weft thread grasping and holding means, said pegs projecting from said cover and fitting into said basic body or viceversa.

The drawing gripper of the same pair of grippers is also characterized by the fact that the thread guard of its head part comprises a profiled appendix, extending parallel to the gripper body for covering the weft thread grasping and holding means.

The invention also comprises shuttleless weaving looms using the aforespecified grippers.

DESCRIPTION OF THE PREFERRED EMBODIMENTS

Figure 1:
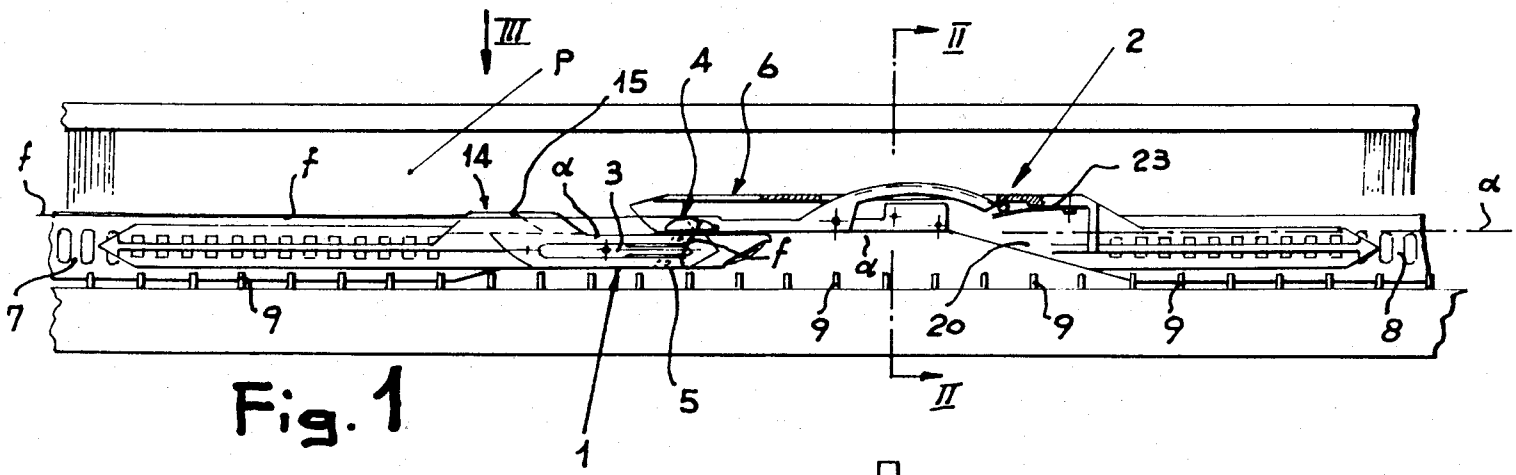
FIG. 1 is a front view of a loom part corresponding to the warp shed, showing a first type of a pair of weft thread transport grippers according to the invention, in a thread exchange position.

As shown in the drawings, the pair of grippers according to the invention comprises a carrying gripper 1 and a drawing gripper 2, in which the weft thread grasping and holding means 3 and 4 are mounted on head parts 5 and 6 of the grippers themselves which are arranged on one side and, respectively, on the other side of a plane $\alpha$ along which the gripper head parts 5 and 6 slide on each other in their working motion, cooperating between them with the mutually sliding parts of each disposed only on one side of that plane for exchanging the weft thread f.

Figure 2:
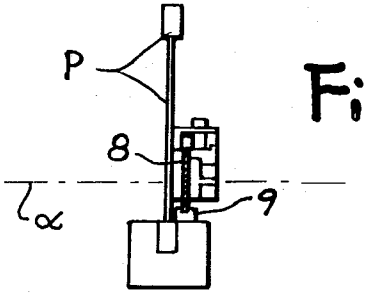
FIG. 2 is a section along the line II–II of FIG. 1.
Figure 3:
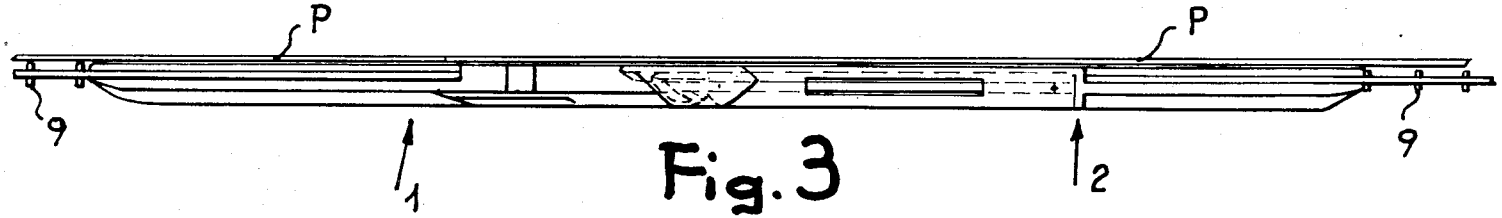
FIG. 3 is a top view according to the arrow III of the arrangement of FIG. 1.

In the arrangement of FIGS. 1 to 3, the plane $\alpha$ is perpendicular to the plane of the reed P, parallel to which are arranged the gripper advancement straps or tapes 7 and 8, sliding in special guiding supports 9, and the grippers themselves.

Figure 4:
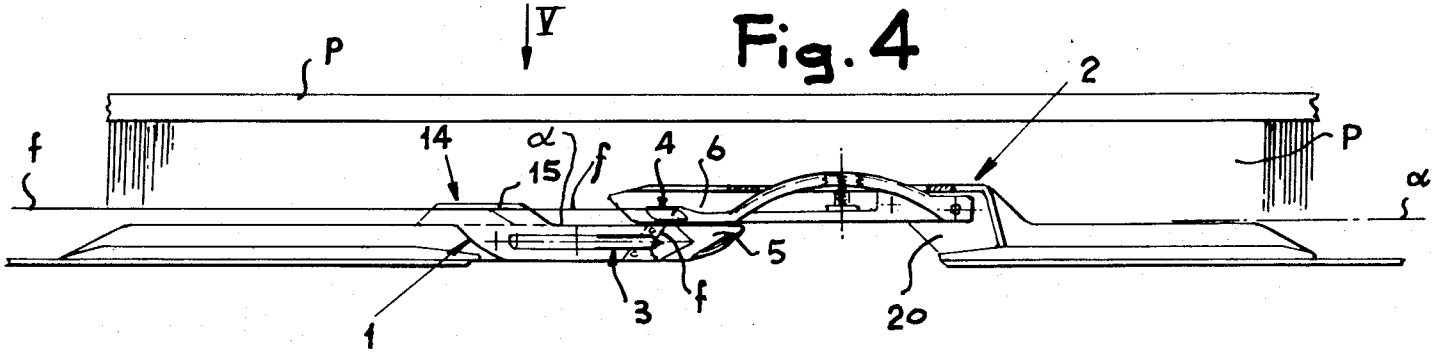
FIG. 4 is a view similar to that of FIG. 1, but showing a modified embodiment of the pair of grippers according to the invention on the loom, in the position of weft thread exchange.
Figure 5:
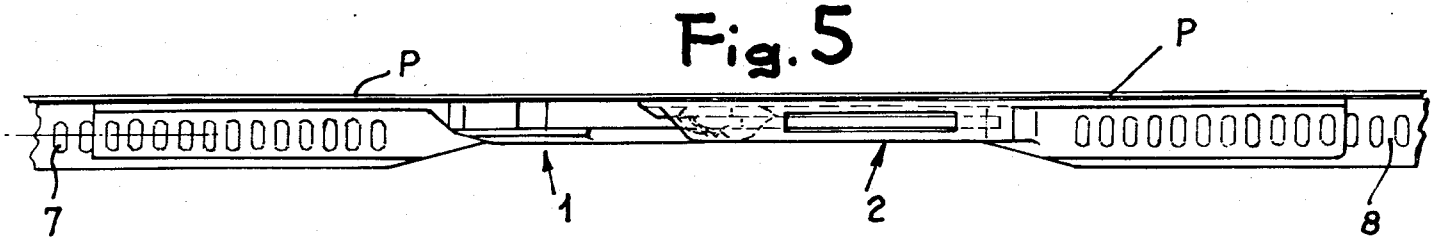
FIG. 5 is a top view according to the arrow V of the arrangement of FIG. 4.

In the arrangement of FIGS. 4 and 5, the plane $\alpha$ and the grippers are again arranged as in FIGS. 1 to 3, while their advancement straps are arranged along a plane parallel to the plane $\alpha$ and move along the same.

Figure 6:
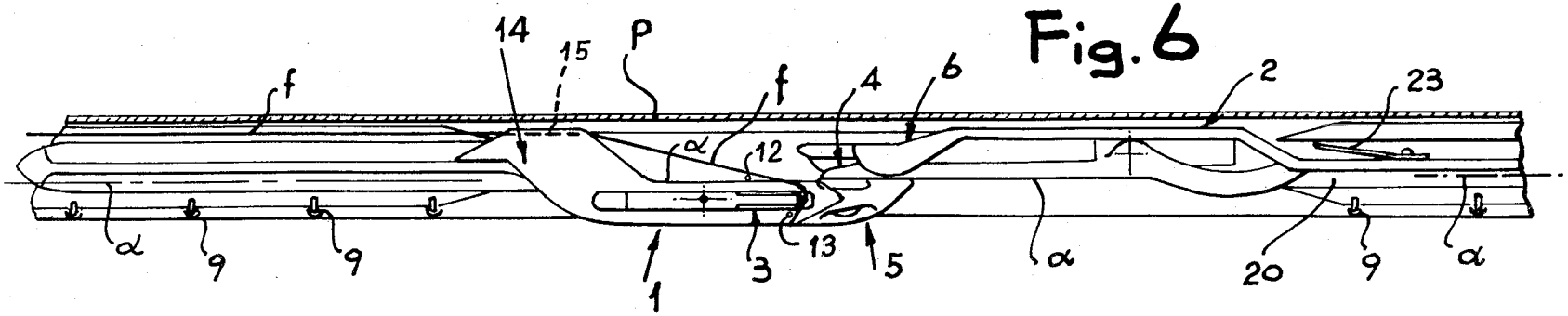
FIG. 6 is a top view of a third embodiment of the pair of grippers according to the invention in a condition which slightly procedes the weft thread exchange between the two grippers.
Figure 7:
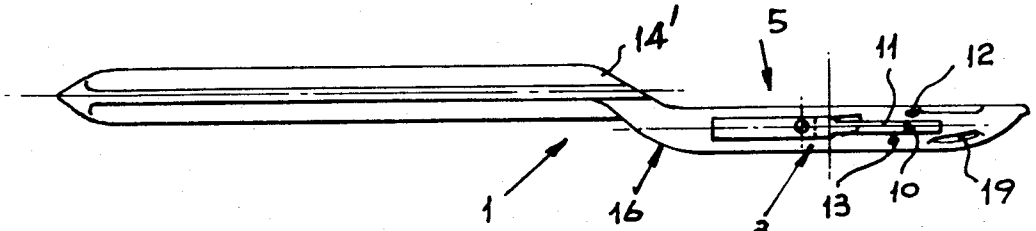
FIG. 7 is a front view of the body part of the carrying gripper, with the cover removed.
Figure 8:
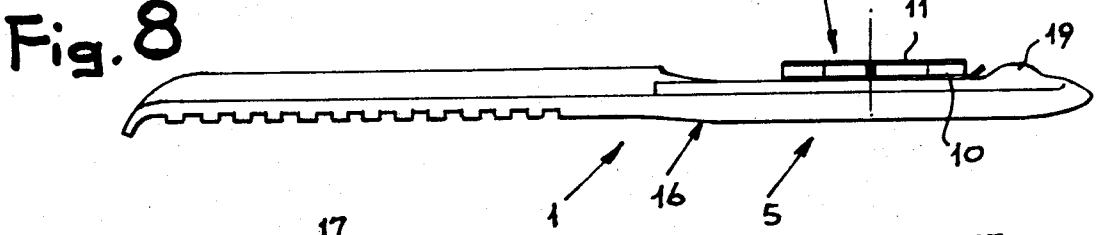
FIG. 8 is a bottom plan view of FIG. 7.
Figure 10:
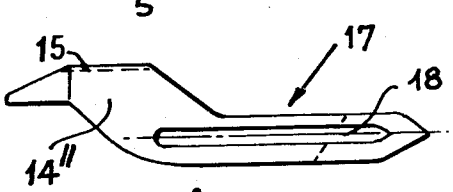
FIG. 10 is a front view of the removed cover of the carrying gripper.
Figure 9:
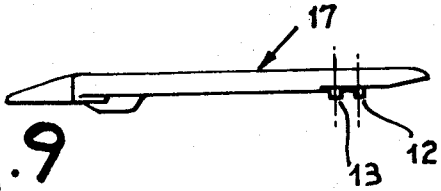
FIG. 9 is a bottom plan view of the removed cover of the carrying gripper.
Figure 12:
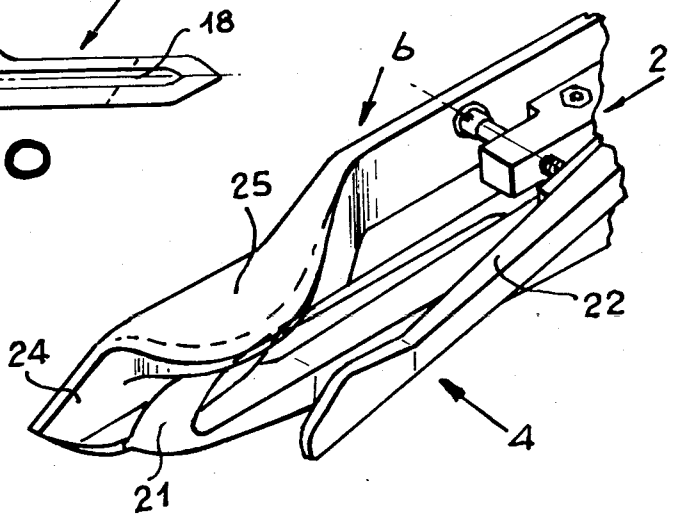
FIGS. 11 and 12 are a schematic side view and a fragmentary perspective view of the head part of the drawing gripper, illustrating the appendix for protecting the thread guard of said gripper.
Figure 11:
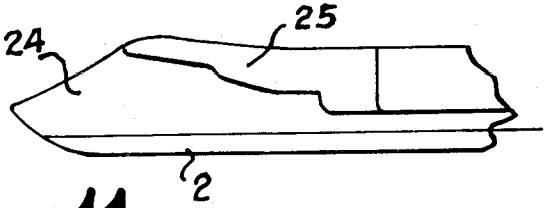

In the arrangement of FIG. 6, the plane $\alpha$ is parallel to the plane of the reed P and the grippers and straps are arranged, more traditionally, perpendicular to said reed plane and parallel to the top plane of the sley (as well as perpendicular to the plane $\alpha$).

Although not shown, other arrangements of the grippers and straps could be provided, with the plane $\alpha$ lying inclined to different extents in respect of the plane of the reed and of the plane of the sley.

The carrying gripper of the pair of grippers according to the invention (FIGS. 1 to 10) comprises a head part 5, in which are mounted the weft thread grapsing and holding members 3, consisting of a longitudinal elastic lamina 10, pressed by a leaf spring 11, which may for example correspond to those of U.S. Pat. No. 3,580,291 and of a pair of pegs 12 and 13, arranged close to the point of said elastic lamina, on one side and on the loom, where it abandons the same, and weft thread grasping and holding members mounted on head parts of the grippers and that cooperate between them for exchanging the weft thread; the improvement in which portions of said head parts of the grippers slide on each other over a portion of the path of the grippers immediately before and after weft thread exchange, the areas of contact between said portions of the respective grippers being disposed in only a single plane, said head portions of the grippers being disposed entirely on opposite sides of said plane for a length along each said head portion which is at least as great as the length of said portion of said path.

* * * * *

United States Patent [19]

Brady

[11] 4,271,874

[45] Jun. 9, 1981

[54] METHOD AND DEVICE FOR INTRODUCING LIQUID INTO BOAT MOTOR COOLING SYSTEMS

[76] Inventor: Darrell B. Brady, 2361 S. Redwood Rd., Salt Lake City, Utah 84119

[21] Appl. No.: 98,606

[22] Filed: Nov. 29, 1979

[51] Int. Cl.[3] ..... B65B 3/04

[52] U.S. Cl. ..... 141/1; 141/98; 141/340; 141/363

[58] Field of Search ..... 115/75, 76; 114/270; 138/32-35; 184/1 R, 106; 141/1, 98, 392, 106, 363, 364, 365, 366, 331-345, 297-300, 199-205

[56] References Cited

U.S. PATENT DOCUMENTS 1,000,150 8/1911 Byrd ..... 141/98

*Primary Examiner*—Houston S. Bell, Jr.
*Attorney, Agent, or Firm*—Mallinckrodt & Mallinckrodt

[57] ABSTRACT

A device for introducing liquid into the cooling system of boat motors having drive units with skags, cavitation plates, propellers, and water intakes, comprises a preferably contoured container adapted to fit about the lower portion of the drive unit and to extend above the cooling system water intake. Such a container fits closely about the drive unit below the water intake but loosely about the water intake and above, so that, when the container is in place about the drive unit, liquid will be sucked into the water passages of the motor. The device may be used in connection with winterizing the motor, and in such case the container will hold a sufficient amount of antifreeze to, when mixed with the water in the cooling system, adequately protect the motor against freezing. The motor is run long enough to distribute the antifreeze through the cooling system. For checking motor operation, with the boat out of water, cool water is run into the container and motor operation is continued as long as required.

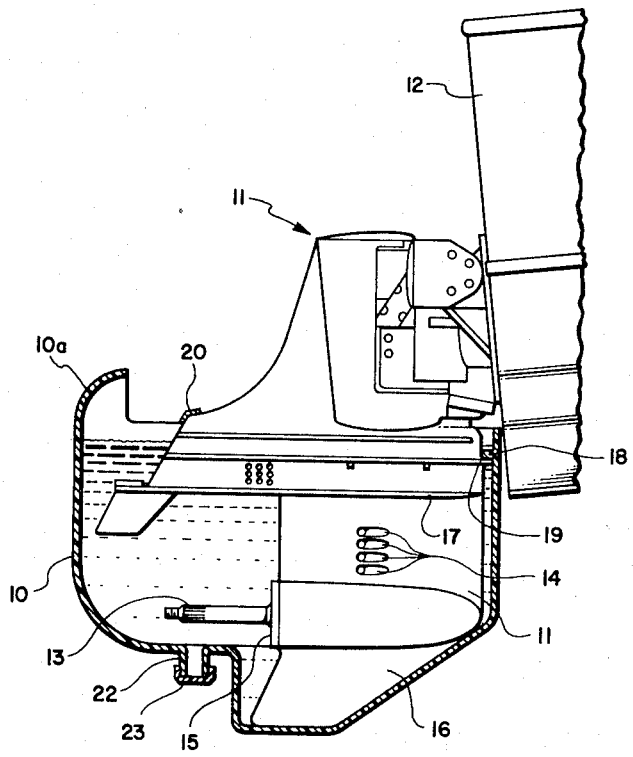

12 Claims, 4 Drawing Figures